US005086593A

United States Patent [19]

Walentine

[11] Patent Number: 5,086,593

[45] Date of Patent: Feb. 11, 1992

[54] MODULAR BUILT-IN STORAGE WALL SYSTEM

[75] Inventor: Ellis B. Walentine, Coopersburg, Pa.

[73] Assignee: J. G. Furniture Systems Inc., Quakertown, Pa.

[21] Appl. No.: 475,958

[22] Filed: Feb. 6, 1990

[51] Int. Cl.[5] ..... E04H 1/06

[52] U.S. Cl. ..... 52/36; 52/33; 312/107; 312/108

[58] Field of Search ..... 312/107, 198; 52/33, 52/35, 36

[56] References Cited

U.S. PATENT DOCUMENTS

| | | | |
|---|---|---|---|
| Re. 15,368 | 5/1922 | McCarthy | 52/33 |
| Re. 31,409 | 10/1983 | Crist . | |
| 1,853,264 | 2/1932 | Bales . | |
| 2,204,319 | 6/1940 | Parsons et al. . | |
| 2,270,710 | 1/1942 | Ring . | |
| 2,438,257 | 3/1948 | Stevenson et al. . | |
| 2,667,401 | 1/1954 | Knuth . | |
| 2,742,675 | 4/1956 | Robertson . | |
| 2,823,424 | 2/1958 | Reinhold | 52/36 |
| 2,966,760 | 1/1961 | Brockway . | |
| 3,245,183 | 4/1966 | Tessin, II. . | |
| 3,281,194 | 10/1966 | Bozarth et al. . | |
| 3,552,817 | 1/1971 | Marcolongo | 312/107 |
| 3,655,065 | 4/1972 | Yellin | 312/107 X |
| 3,835,354 | 9/1974 | Torres-Pena . | |
| 3,841,037 | 10/1974 | Clark | 52/36 |
| 4,076,350 | 2/1978 | Crist . | |
| 4,077,686 | 3/1978 | Bukaitz . | |
| 4,243,279 | 1/1981 | Ackeret | 312/107 |
| 4,360,991 | 11/1982 | West . | |
| 4,470,647 | 9/1984 | Bishoff et al. | 312/108 |
| 4,660,901 | 4/1987 | Shimada . | |
| 4,682,457 | 7/1987 | Spencer . | |
| 4,717,214 | 1/1988 | Moore et al. | 312/107 |

OTHER PUBLICATIONS

"Contract" magazine, Nov. 1979 issue, p. 94–99.

*Primary Examiner*—Richard E. Chilcot, Jr.
*Assistant Examiner*—Joanne C. Downs
*Attorney, Agent, or Firm*—Nixon & Vanderhye

[57] ABSTRACT

An integral modular built-in storage wall system is provided including a plurality of prefabricated modular base components, each having a supporting surface mounted to four adjustable legs located at four corners of the suppport surface, and at least a first removable front cover extending between forward facing surfaces of a first forward pair of the legs. The base also has open side areas between the first and second pair of legs so that, when a plurality of said base components are aligned in side-by-side relationship, a substantially unobstructed passage is created extending along the plurality of base components beneath the top walls thereof. A plurality of prefabricated modular storage components are also provided for mounting on individual ones of the base components. The storage components have substantially uniform depth and height dimensions, but the width dimensions may vary in accordance with a predetermined modular format based on the total width of the wall system.

25 Claims, 4 Drawing Sheets

FIG. 4
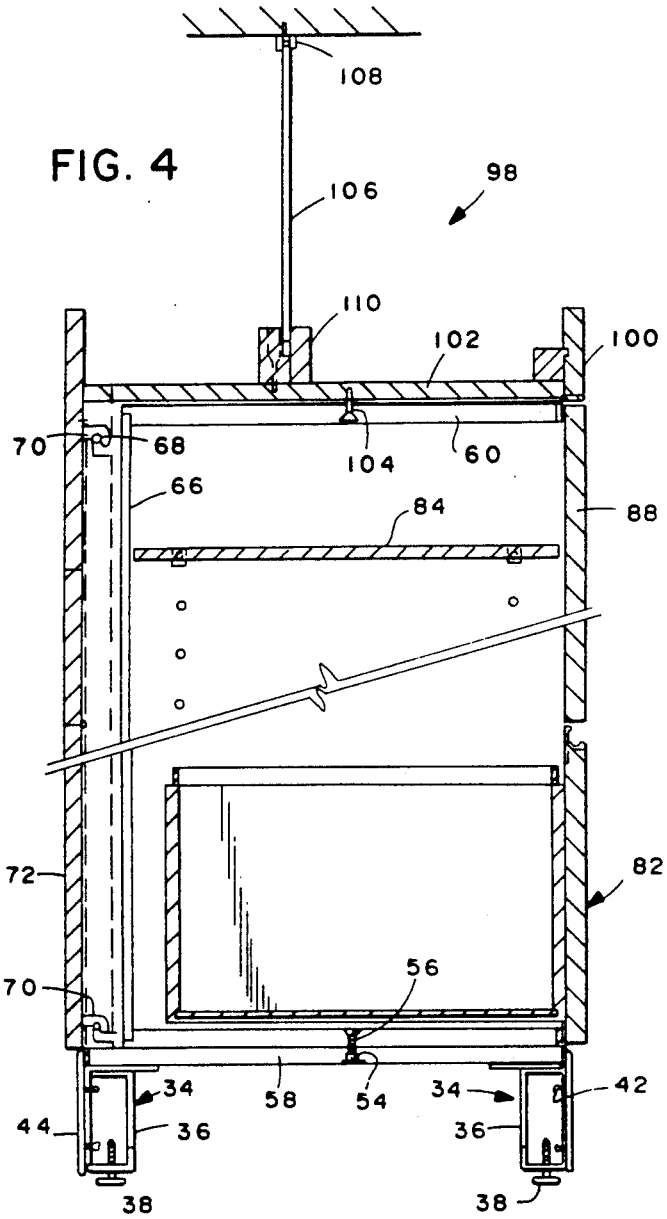
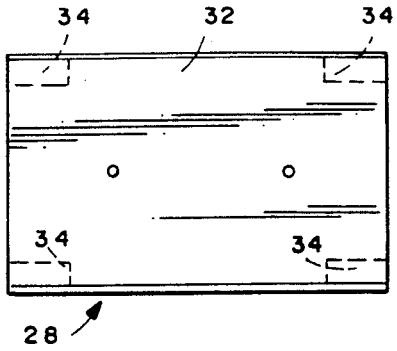
FIG. 6
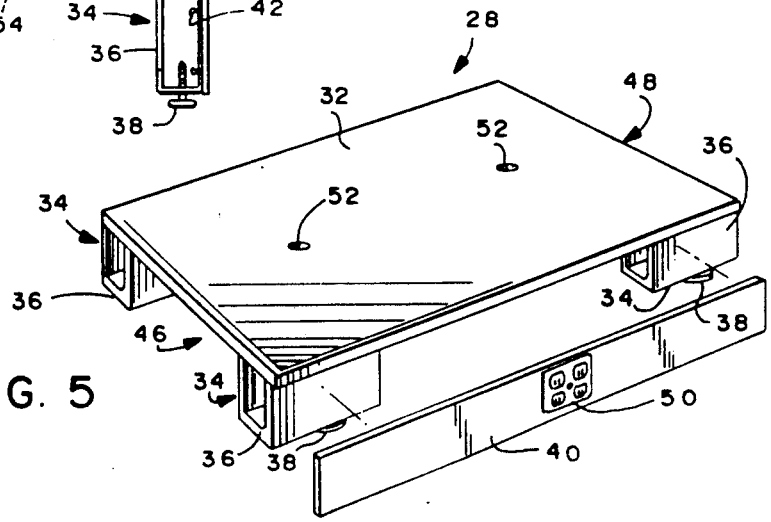
FIG. 5

MODULAR BUILT-IN STORAGE WALL SYSTEM

BACKGROUND AND SUMMARY OF THE INVENTION

The present invention relates to wall storage systems typically employed in open plan office spaces which enable the building occupant to custom design a floor plan to meet the specific needs of the occupant. In accordance with this invention, a unique wall system is provided which utilizes prefabricated and wholly self-contained modular base components and storage components which can be installed with minimum labor and installation cost, and which can be rearranged as desired with similar labor and cost benefits.

It is known to design open office floor plans utilizing so-called "systems furniture" which permits rearrangement and restructuring without the time consuming effort of tearing down and rebuilding the otherwise "permanent" walls. For example, it is known to utilize storage components as interior walls, where all such components have a standardized height, with a clerestory extending from the top of the storage wall to the ceiling. Such systems, however, have required on-site assembly and construction of most if not all components of the wall system. In addition, the system is not modularized so that replacement of any individual section of the wall system required time consuming dismantling and reconstruction, particularly since individual units shared adjacent side walls and horizontal members extended a considerable length along the wall system.

In accordance with the present invention, a factory constructed set of modular elements, wholly self-contained, are provided which create a built-in appearance, but which allow for minimum on-site installation labor and hence cost. In addition, the wall system in accordance with the present invention permits subsequent changes in configuration with similar savings in labor and cost.

It is therefore a principal feature of the present invention that the wall system comprise modular base components for supporting a like of modular storage components, each being self-contained and structurally self-sufficient.

It is another feature of the present invention to permit the installation and reconfiguration of the modular wall system independent of the electrical installation. In other words, the modular base components allow a full modular electrical and electronic office wiring program to pass therethrough independent of any installation, removal or replacement of one or more modular storage components. Accordingly, the system in accordance with this invention allows replacement of individual storage components without replacement of the associated base components, and therefore without rewiring or interruption of electrical service, and/or the need for the services of electricians.

It is another feature of the invention to provide modular storage components which include hang-on panels on the "back" side of the storage components for an attractive built-in appearance in those instances where the components are visible from the front or back.

It is another feature of the present invention to provide a set of modular storage components for a built-in configuration which permits the utilization of clerestory elements which complete the floor-to-ceiling appearance.

It is another feature of the present invention to provide a factory constructed set of modular base and storage components which are built in accordance with standardized modular dimensions calculated to fit standard building lay-out grids.

In accordance with one exemplary embodiment of the invention, therefore, a modular base component is provided which includes four self-leveling leg structures secured to an upper supporting surface. Each base component also includes front and rear (optional) cover plates to provide an attractive appearance, but the otherwise out-of-view side areas of the base components are left open to permit the passage of communications and/or electrical cables beneath and along a plurality of adjacent base components. In an alternative embodiment, a welded frame construction is used for the base component.

In further accord with this exemplary embodiment of the invention, modular storage components are provided, each of which includes a bottom wall, a top wall, two side walls and a back wall. From this basic storage component structure, various unit configurations are possible including clothing storage units, adjustable shelf units, file drawer units, bookshelf units and the like, with or without forward facing access doors. In each case, however, the storage component is prefabricated at the factory as a structurally self-sufficient component, having substantially uniform exterior dimensions.

At the site of installation, the required number of base components are aligned in side-by-side relationship, with communications and/or electrical cables beneath the base components and extending through the open side areas thereof. Individual storage components are then mounted or stacked on the respective base components and are fastened to the base components and to adjacent storage components with a minimum number of fasteners. It is preferred that the fastener locations for all components be identical and symmetrical so that one or more individual components can be reversed i.e., rotated so that users on both sides of the storage wall may, if desired, have access to one or more of the storage components.

Dimensions for the base components and modular storage components are to be substantially uniform for any given project or installation, with exceptions noted. Initially, however, it will be helpful if the dimensions are first defined for purposes of this application. Depth refers to the front-to-back dimension width refers to the far left side-to-far right side dimension; and height refers to the top-to-bottom dimension.

Depth and height dimensions in preferred arrangements will be uniform for any given project or installation, but may change from project to project based on available space, etc. The width dimensions, however, may be uniform or may vary within a single installation, as will be explained in further detail herein.

In a preferred arrangement, the base components and storage components are located so as to be centered with respect to ceiling grids or tracks to permit the further installation of a clerestory between the storage components and the ceiling grid or track as desired.

Thus, in accordance with one exemplary embodiment of the invention, a modular storage wall system is provided which comprises a plurality of prefabricated modular base components having, for any given project or installation, substantially uniform depth and height dimensions, each base component including a plurality of support legs and a top surface for supporting a wall component thereon, the base components further being configured to permit passage of cables therethrough; a plurality of prefabricated modular storage components, also having substantially uniform depth and height dimensions, the depth and width dimensions of the storage components being substantially identical to the depth and width dimensions of the modular base components; and fastening means for releasably securing said storage components to an underlying base component and to adjacent storage components, such that any one of the storage components can be removed without disturbing any other of the storage components or any of the base components.

In another aspect of the invention, the modular storage base component is provided which includes a free-standing, rectangular base component for supporting a storage component, the base component comprising a rectangular top wall mounted on four, self-leveling legs located at four corners of the top wall; and a first removable front cover extending between forward facing surfaces of a first forward pair of the legs. A second removable rear cover extending between rearward facing surfaces of a second rearward pair of the legs may be utilized.

Additional objects and advantages of the present invention will become apparent from a detailed description of the invention which follows.

BRIEF DESCRIPTION OF THE DRAWINGS

FIG. 4 is a side section of a modular storage component in accordance with the invention;

FIG. 5 is a perspective view of a modular base component in accordance with the invention with a front cover plate separated therefrom;

FIG. 6 is a plan view of the base component shown in FIG. 5; and

DETAILED DESCRIPTION OF THE DRAWINGS

Figure 1:
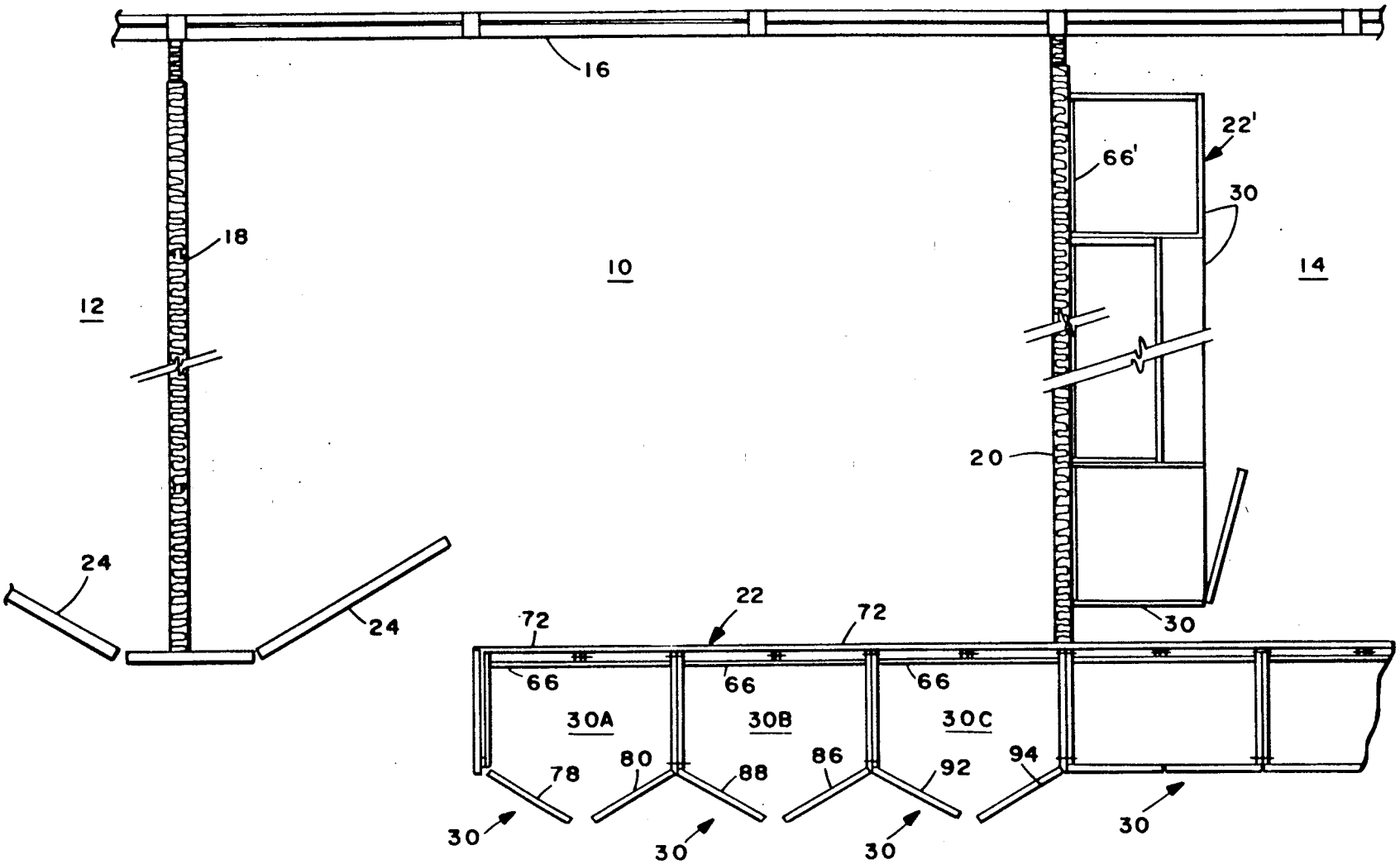
FIG. 1 is a partial plan view of a wall system according to an exemplary embodiment of the invention.
Figure 2:
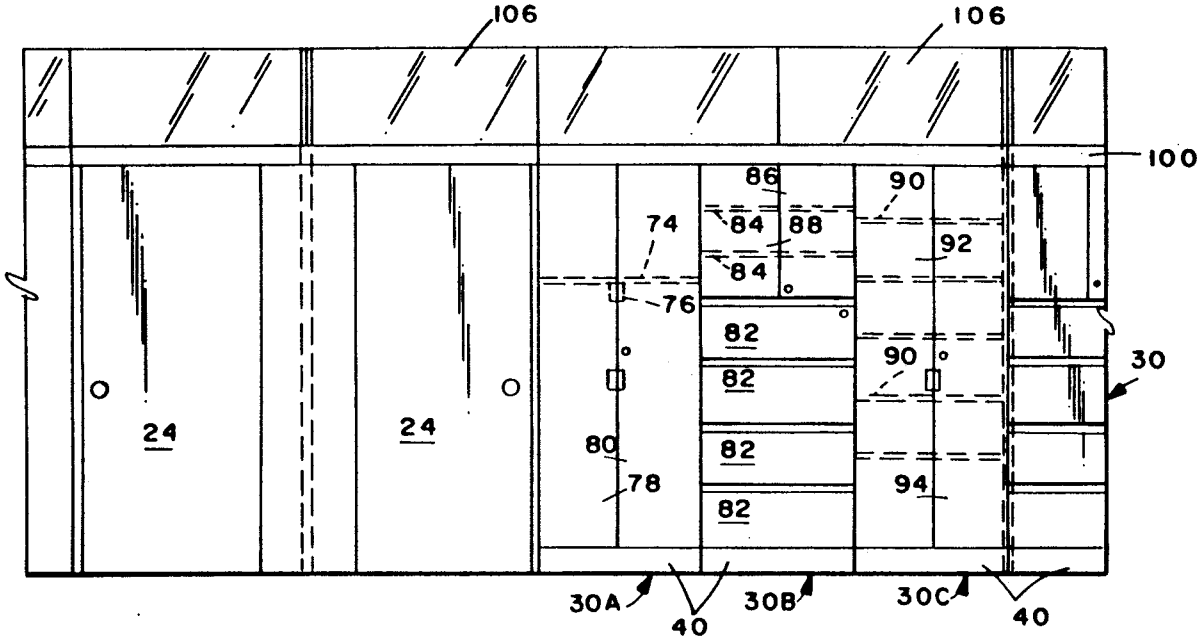
FIG. 2 is a front view of the wall system shown in FIG. 1.

FIG. 1 illustrates a partial floor plan for an office layout incorporating wall systems in accordance with this invention.

The building is divided into a number of office spaces, three of which are shown at 10, 12 and 14. Typically, similar office spaces would extend about the outer periphery of the building floor, with common areas, service areas (elevators, etc.) and special purpose rooms arranged in the interior space.

While the invention will be described below in the context of adjacent office spaces about the outer periphery of the building, it will be understood that virtually any interior, non-structural wall may comprise a modular, built-in storage wall system in accordance with this invention.

The office space 10 is defined by an exterior building wall 16, a pair of conventional side walls 18, 20 and a front wall 22. The latter wall is constructed in accordance with this invention. In fact, as is apparent from FIG. 1, wall 22 serves as the front wall for adjacent office spaces 12, 14, etc., with interruptions only at the location of the doors 24 for each office.

It will be further appreciated that the conventional side walls 18 and 20 may be replaced by wall systems constructed in accordance with this invention. In addition, and as also shown in FIG. 1, the office space 14 is shown to have a "built-in" wall system 22' in accordance with the invention, installed along a portion of the wall 20. It will thus be appreciated that the wall system of this invention may be utilized in a number of different settings, including free standing, and in combination with an existing wall to thereby provide great flexibility in the design and layout of office space.

With reference also to FIGS. 2 and 4 through 6, the storage wall 22 is constructed of a plurality of prefabricated, modular base components 28, arranged in side-by-side relationship, each supporting a prefabricated, modular storage component 30.

Referring particularly to FIGS. 4–6, each base component 28 includes a supporting surface 32 which is preferably ¾" standard Melamine-coated particle board, but other materials such as wood or steel can also be used. Four steel leg structures 34 are fastened to the underside of the supporting surface 32 by any suitable means. Preferred heights for the base components are 5.5 inches where the ¾ inch Melamine particle board is used, or 4.5 inches where steel weldments are used as the supporting surface (see the description below of the welded frame construction shown in FIG. 7).

Each leg structure comprises a beam-like, open section 36, with a conventional leveling screw 38 threadably secured in the bottom of the section 36.

The front side of the base is preferably covered by a steel base cover 40 which may be snapped or screwed into place, using conventional fasteners 42. The rear side of the base may be similarly covered with another steel base cover 44 (see FIG. 4), although this may be omitted if the wall system backs up to a finished wall as shown in the office space 16 of FIG. 1.

The side areas of the base component, shown generally at 46, 48 in FIG. 5, remain open so that communications and/or other electrical cables, such as modular cable assemblies, can extend freely along and beneath the base components as will be explained more fully below. In this regard, front cover plates 40 may be provided with electrical outlet plates 50 (FIG. 5), as required, along the length of the wall system. It will be appreciated that the use of modular cables in this installation will obviate the need for electricians and result in lower installation cost.

The upper surface 32 of the base component is also provided with a pair of holes 52 which receive threaded bushings 54 (FIG. 4), which, in turn, are adapted to receive screw fasteners 56 in order to secure an associated storage component 30 in a manner described below.

The storage components 30 may have a variety of configurations including a clothing storage unit 30A, a combination file/storage unit 30B, and a bookshelf/storage unit 30C (with or without doors). This invention, however, is not in any way limited to specific configurations for the storage components 30, and those skilled in the art will readily appreciate that many other storage component configurations may be employed.

Whatever the unit configuration, the storage components have a number of common elements. For example, each component is constructed of a bottom wall 58, a top wall 60, a pair of side walls 62, 64 and a back wall 66. Each of these walls, with the exception of the back wall, is preferably constructed of ¾ inch standard melamine-coated particle board. The back wall is preferably the same material but with a ⅜ inch thickness.

This basic five-sided structure is held together by fasteners such as screws, adhesives, or combinations of both.

Figure 3:
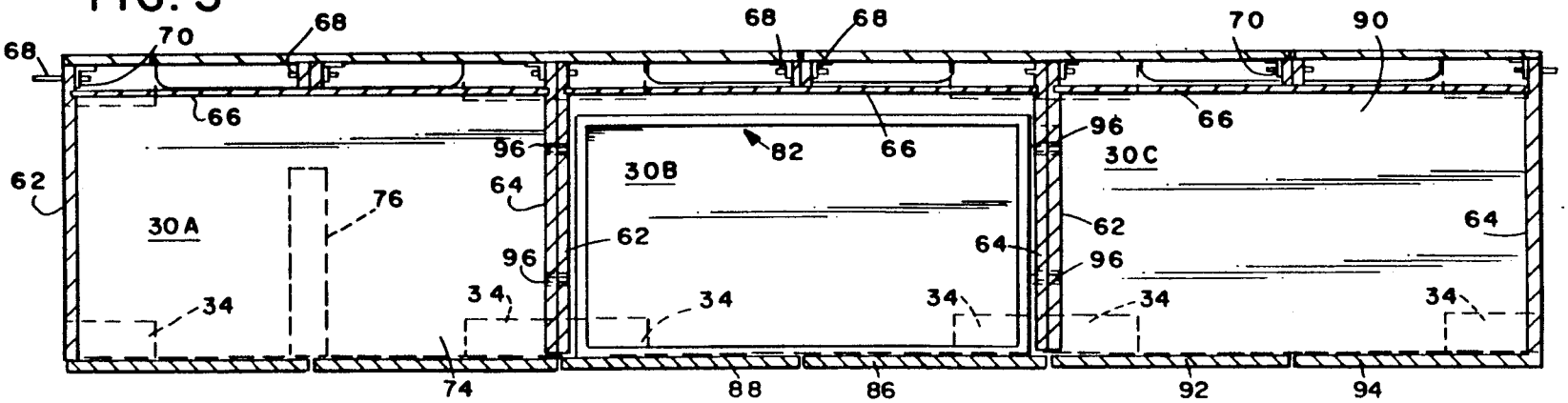
FIG. 3 is a partial, enlarged plan section of the wall system shown in FIG. 1.

With reference to FIGS. 3 and 4, it may be seen that the side walls 62 and 64 extend rearwardly beyond the back wall 66. The extended side wall portions are provided with a plurality of brackets carrying steel pins 68 which enable a decorative panel 72 to be secured to the back of the component via brackets 70 which "hang" on the pins 68. Panel 72 may have upholstery, wood veneer, or any other suitable material applied to the exposed side thereof. This arrangement provides a uniformly attractive appearance along the back of the wall system, and is used where both sides of the wall system are exposed, as in the office space 10.

For those applications where the wall system backs up to an existing wall, as in space 14, a ¾ inch back wall 66' will be secured directly to the rearward ends of the side walls 62, 64, and no additional fabric-backed panel 72 is necessary.

The panel 72 comprises, in one exemplary embodiment, a ½ inch Micore TM 230 panel with any suitable upholstery or other material, e.g. wood veneer, secured by staples or other suitable fastening means to the back side thereof. Typically, the panels 72 have widths of about 48 inches, so that they may overlap the components 30 (depending on component width dimensions) as best seen in FIG. 3.

From the standard box-like construction described above, the storage components 30 may be finished in a variety of configurations as also noted above. For example, the clothing storage unit 30A is provided with a storage shelf 74 and a bracket 76 for supporting clothes hangers, and a pair of front access doors 78, 80.

The file cabinet/storage unit 30B is provided in one exemplary embodiment, with four file drawers 82, two adjustable shelves 84, and a pair of access doors 86, 88 to access the shelves.

The bookshelf/storage unit 30C may include five (or as few or many as desired, given the size of the unit) adjustable shelves 90 and a pair of access doors 92, 94.

It is important to note that each of the modular base components 28 and modular storage components 30 (in whatever particular unit configuration), is constructed and fully assembled as wholly self-contained and structurally self-sufficient components at the manufacturing plant. Moreover, the dimensions of all base components and storage components are standardized and designed for compatibility with conventional building lay-out grids. For example, in one embodiment of the invention, all of the base components 28 and storage components 30 may be approximately 32 inches in width, and approximately 20 inches in depth. The base components 28 may have a height of approximately 4½ inches, while the storage components may have a height of approximately 80 inches. Alternatively, individual storage components could be made with 16 inch widths, a pair of such components being supported on a single base component 30. Similarly, storage components can be constructed with heights less than 80 inches, but which are vertically stackable to reach a combined height of 80 inches.

Generally, as previously noted hereinabove, the base components and storage components will have substantially uniform height and depth dimensions for any given project or installation, but may vary from project to project. For example, where floor-to-ceiling height is somewhat less than standard, all of the storage components of a wall system may have a reduced height of about 78 inches. As another example, the depth of all of the base and storage components of a wall system might be increased to 22 or 24 inches where space is plentiful.

On the other hand, width dimensions of individual base and storage components within a given wall system may be the same, or may differ according to a standardized modular format calculated to permit various combinations of widths, the totality of which will fill a predetermined modular planning space.

For example, for a 6 foot wall section or planning module, width dimensions of 12, 18 or 24 inches may be used, for example, in any combination that will result in a 6 foot long wall section. If the planning module is 8 feet, storage module widths of 16, 32, 48 inches may be used. Width dimensions for other planning modules or wall section lengths may vary accordingly. The widths for the base components will, of course, vary with the widths of the storage components.

This scheme facilitates production of standardized modular components which can be selected for use in various combinations to provide the desired overall configuration for the wall system.

At the installation site, the modular base components 28 are installed along the desired wall location, preferably centered beneath a ceiling grid or track. The base components 28 need only be aligned in side-by-side relationship, since it is not necessary to secure the base components to either the floor or adjacent base components.

Thereafter, after the communications and/or electrical cables have been strung along the wall site, through the open-sided areas of the adjacent base components 28, the modular storage units 30, in whatever unit configuration and in whatever sequence is desired, are mounted directly in vertical alignment on the upper supporting surfaces 32 of the base components. In other words, each base component supports one (or two) storage component, and there is no overlapping relationship therebetween.

Alternatively, because of the relatively wide space available for the cables, cable installation may be accomplished after installation of the storage modules 30, but before installation of the base front cover plates 40.

Adjacent storage components 30 are fastened together by four connectors, preferably ¼-2D connector bolts 96, as shown in FIG. 3. As noted hereinabove, a single screw is utilized to fasten each storage modular 30 to its respective base component 28.

Because the fasteners are located identically and symmetrically for all components, individual components can be moved about, and even rotated 180° within the wall system, quickly and easily without concern for whether or not fasteners on adjacent components will "match up".

It will be appreciated that, depending on the building and floor plan lay-outs, an odd dimension, i.e., something less than 32 inches, may (but not necessarily) remain to be custom fit at one or the other ends of the wall system. This can be solved by on-site modification of one of the base and storage components to insure a customized, built-in appearance. In a preferred arrangement, however, any relatively small, odd space remaining in a given planning space will be filled in by "blank"

fillers or spacers to minimize the need for extensive custom work and expense.

After assembly of the base and storage components, the installation may be additionally "finished" by the attachment of a clerestory between the storage components 30 and the ceiling, as best seen in FIG. 4. To this end, a soffet assembly 98 may be installed including a forward facing vertical soffet member 100, and one or more sections of horizontal supports 102. Supports 102, which extend across more than one storage component 30, are fastened to each storage component by two fasteners 104. One or more sections of, for example ¼" laminated clear glazing 106 are then secured between the ceiling track 108 and one or more base blocks 110 attached to the supports 102. Since ceiling heights may vary, and since the height of all of the base and storage components is standardized, the glazing panels may be easily custom fit to the difference in height between the top of the storage components and the particular ceiling grid or track.

It will be appreciated, of course, that any suitable material may be used as the clerestory. For example, veneer, stone, fabric-backed panels and the like may also be employed.

In the event a clerestory as above described is utilized, the panel 72, may extend beyond the top wall of the storage component, to approximately the same extent as soffet 102 to thereby provide a uniform, attractive appearance, hiding the base block 10 from view. Alternatively, soffet members 100 may be used on both front and back sides of the wall system.

With the above described arrangement, it will be appreciated that any individual modular storage component 30 can be easily removed from any section of the wall system and replaced with a component having the same or different unit configuration. To do so, the back panel 72, if present, is removed and the bottom wall fasteners 56, top wall fasteners 104 (when a clerestory is installed) and the four fasteners 96 on each side wall, are also removed. The storage component 30 is then slidably removed from the base component 28. Replacement is achieved in a similar manner, reversing the above described steps.

Figure 7:
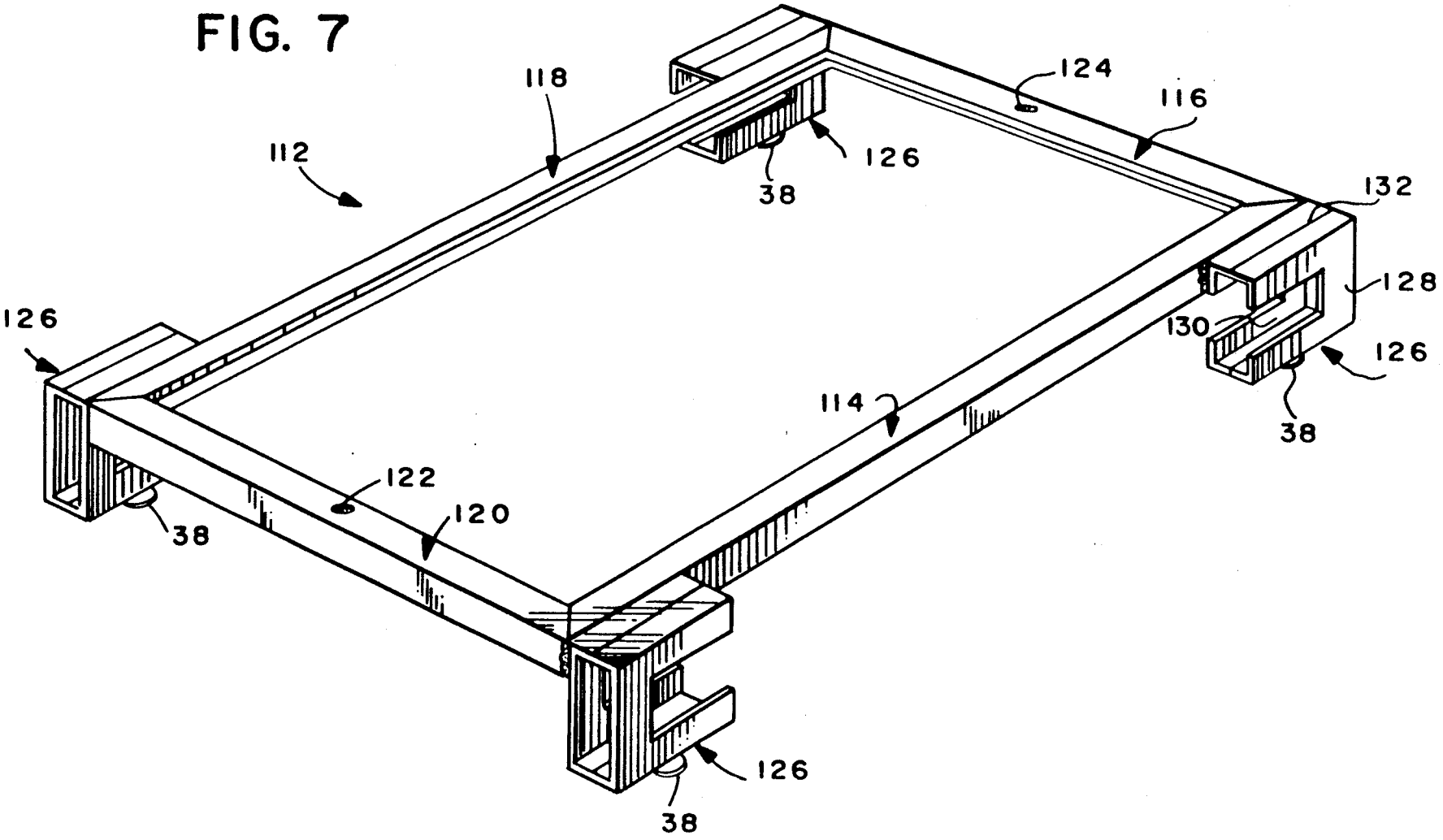
FIG. 7 is a perspective view of an alternative modular base component in accordance with the invention.

Another exemplary embodiment of the base component is shown in FIG. 7. This modified base component 112 is formed by two pair of angles 114, 118 and 116, 120, arranged in a rectangular shape (e.g. 31 15/16 inches in width and 19 inches in depth), and welded together at the four corners thereof. The angles are preferably, but not necessarily 1×1×⅛ inch hot rolled structural steel. Holes 122, 124 are drilled at opposite locations in opposed angles 116, 120 for receiving fasteners (not shown) which secure at associated storage component 30 to the base component 112 in the same manner as described hereinabove. It will be appreciated that the top surfaces of each of the angles 114, 116, 118 and 120 provide a supporting surface for the associated storage component 30.

Legs 126 are welded at each of the four corners of the rectangular-shaped base component, each leg being formed by a pair of U-shaped angle members 128, 130 joined along a weld line 132. Each leg is also provided with a leveling screw 38 as previously described. A front plate 40 (and rear plate 44 if desired) can be secured to the base component, also as previously described. All of the advantages of the base component 28 accrue to this alternative embodiment, but this embodiment has the further advantage of a lower height, e.g., 4.5 inches, which is particularly useful with storage components having heights of about 80 inches.

The removal and replacement of one or more storage components is thus easily achieved with minimum labor, and without any disturbance of the communications and/or electrical cables extending along the floor, through the base components.

Moreover, it will be apparent that removal of the storage components, rearrangement of the base components, and reinstallation of the storage components is also easily achieved, facilitating a total redesign of the floor plan with minimal effort and cost.

In summary then, the present invention allows for the installation of a custom wall system having an attractive, built-in appearance with minimum labor and minimum installation costs. This is achieved through the use of prefabricated, wholly self-contained base and storage components having standardized dimensions as described herein. In addition, replacement of one or more storage components, or rearrangement of the entire wall system is also easily achieved with similar savings in labor and cost, and without any interruption of electrical service.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An integrated office furniture system including at least one modular storage wall comprising:

a plurality of prefabricated modular base components arranged adjacent one another, each having width, depth and height dimensions, the depth and height dimensions of said plurality of base components being substantially uniform; each base component including a plurality of support legs and a supporting surface for supporting a storage component thereon, said support legs arranged to provide openings along the depth dimensions of said components to thereby permit passage of cables therethrough along the width dimensions of said base components;

a plurality of prefabricated modular storage components mounted on respective ones of said base components, each storage component having width, depth and height dimension, the depth and height dimensions of said plurality of storage components being substantially uniform, and the depth and width dimensions of said storage components being substantially identical to the depth and width dimensions of associated ones of said modular base components; and means for permitting any one of said storage components to be removed from a respective one of said base components without disturbing any other of said storage components or any of said base components.

2. The integrated office furniture system according to claim 1 wherein each of said prefabricated modular base components and said prefabricated modular storage components are self-contained units which do not depend on adjacent units for structural integrity.

3. The integrated office furniture system according to claim 1 wherein the modular storage components have standardized but not necessarily identical modular width dimensions calculated to fit within a predetermined planning space.

4. The integrated office furniture system according to claim 1 wherein said modular base component supporting surface comprises a substantially flat sheet mounted on said support legs.

5. The integrated office furniture system according to claim 1 wherein said modular base component supporting surface comprises an open rectangular frame secured to said support legs.

6. The integrated office furniture system according to claim 1 wherein each of said prefabricated modular storage components has a height dimension of approximately 80 inches.

7. The integrated office furniture wall system according to claim 1 wherein each of said prefabricated modular base and storage components has a depth dimension of approximately 20 inches.

8. The integrated office furniture system according to claim 1 wherein said prefabricated modular storage components include bookshelf units.

9. The integrated office furniture system according to claim 1 wherein said prefabricated modular storage components include cabinet units having one or more file drawers.

10. The integrated office furniture system according to claim 1 wherein said prefabricated modular storage components include cabinet units having one or more shelves.

11. The integrated office furniture system according to claim 1 wherein said prefabricated modular storage components include at least one bookshelf unit and at least one cabinet unit.

12. The integrated office furniture system according to claim 1 wherein said plurality of prefabricated modular storage units includes vertically stackable units, a plurality of removable fasteners adapted to extend between adjacent ones of said stackable units.

13. The integrated office furniture system according to claim 1 and further including clerestory panels extending between said modular storage components and a ceiling grid.

14. The integrated office furniture system according to claim 1 wherein each of said prefabricated modular storage elements includes at least a bottom wall, top wall, a pair of sides and a rear panel.

15. The integrated office furniture system according to claim 14 wherein said means include removable fasteners adapted to extend between side panels of adjacent and laterally aligned ones of said plurality of prefabricated modular storage components in substantially identical and symmetrical locations.

16. The integrated office furniture system according to claim 14 wherein said means include removable fasteners adapted to extend between said bottom wall and said modular base component supporting surface in substantially identical and symmetrical locations.

17. The integrated office furniture system according to claim 14 wherein said rear panel is covered on an exterior side thereof with a decorative panel.

18. An integral, modular furniture storage wall system comprising:

a plurality of prefabricated modular base components in side-by-side relation, each comprising a supporting surface secured to four adjustable legs located at four corners of said supporting surface; and at least a first removable front cover extending between forward facing surface of a first forward pair of said legs, and further comprising open side areas between said first and second pair of legs so that, when a plurality of said base components are aligned in side-by-side relationship, a substantially unobstructed passage is created extending along said plurality of base components beneath the top walls thereof; said base components each having width, depth and height dimensions;

a plurality of prefabricated modular storage components, each adapted to be mounted on the supporting surface of an associated base component, and each having width, depth and height dimensions, wherein the depth and height dimensions of said storage components are substantially uniform, and wherein the depth and width dimensions of said storage components are substantially identical to the depth and width dimensions of said associated modular base components, each of said prefabricated modular storage elements including at least a bottom wall, top wall, a pair of side walls and a rear panel; and fastener means for permitting any one of said storage components to be removed from an associated one of said base components without disturbing any other of said storage components or any of said base components.

19. An integrated modular storage wall system according to claim 18 wherein each of said prefabricated modular storage components are self-contained units which do not depend on adjacent units for structural integrity.

20. The wall system according to claim 18 wherein said rear panel is covered on an exterior side thereof with a fabric-backed panel.

21. The wall system according to claim 18 wherein the width dimensions of said modular storage components are standardized but not necessarily identical, and are calculated to fit within a predetermined planning space.

22. The wall system according to claim 18 and further including panels extending between said modular storage components and a ceiling grid.

23. The wall system according to claim 18 wherein said fastener means comprise first removable fasteners adapted to extend between said panels of adjacent and laterally aligned ones of said plurality of prefabricated modular storage components in substantially identical and symmetrical locations.

24. The wall system according to claim 23 wherein said fastener means further comprise second removable fasteners adapted to extend between said bottom wall and said supporting surface in substantially identical and symmetrical locations.

25. An integral modular office furniture system comprising:

a plurality of prefabricated modular base components, each comprising a supporting surface secured to four adjustable legs located at four corners of said supporting surface; and at least a first removable front cover extending between force facing surfaces of a first forward pair of said legs, and a second removable rear cover extending between rearward facing surface of a second rearward pair of said legs, and further comprising open side areas between said first and second pairs of legs so that, when a plurality of said base components are aligned in side-by-side relationship, a substantially unobstructed passage is created extending along said plurality of base components beneath the top walls thereof; said base components each having width, depth and height dimensions;

a plurality of prefabricated modular storage components, each adapted to be mounted on the supporting surface of an associated base component, and each having width, depth and height dimensions, wherein the depth and height dimension of said storage components are substantially uniform, and wherein the depth and width dimensions of said storage components are substantially identical to the depth and width dimensions of said associated modular base components, each of said prefabricated modular storage elements including at least a bottom wall, top wall, a pair of side walls and a rear panel;

fastener means for permitting any one of said storage components to be removed without disturbing any other of said storage components or any of said base components.

* * * * *